US005275229A

United States Patent [19]

Fishman et al.

[11] Patent Number: 5,275,229

[45] Date of Patent: * Jan. 4, 1994

[54] MAGNETIC SUSPENSION MELTING APPARATUS

[75] Inventors: Oleg S. Fishman, Maple Glen, Pa.; Rudolph K. Lampi, Tabernacle; Vitaly Peysakhovich, Morrestown, both of N.J.

[73] Assignee: Inductotherm Corp., Rancocas, N.J.

[ * ] Notice: The portion of the term of this patent subsequent to May 14, 2008 has been disclaimed.

[21] Appl. No.: 857,052

[22] Filed: Mar. 25, 1992

[51] Int. Cl.[5] ..... B22D 27/02; H05B 6/00

[52] U.S. Cl. ..... 164/513; 164/493

[58] Field of Search ..... 164/493, 513, 471, 507; 219/10.43, 10.491, 10.79; 373/139

[56] References Cited

U.S. PATENT DOCUMENTS

| | | | |
|---|---|---|---|
| 4,215,738 | 8/1980 | Gaule et al. . | |
| 4,432,093 | 2/1984 | Reboux | 373/157 |
| 4,989,666 | 2/1991 | Weber | 164/467 |
| 5,014,769 | 5/1991 | El-Kaddah et al. | 164/493 |
| 5,033,948 | 7/1991 | El-Kaddah et al. | 425/8 |

*Primary Examiner*—Kuang Y. Lin

*Attorney, Agent, or Firm*—Seidel, Gonda, Lavorgna & Monaco

[57] ABSTRACT

Apparatus for inductively melting a quantity of metal without a container includes a first induction coil having a plurality of turns defining a volume for receiving a quantity of metal, the first induction coil being adapted to exert a force on the metal, a second induction coil having a plurality of turns at substantially right angles to the turns of the first induction coil, the second induction coil, being disposed within said volume coaxial with the first induction coil. Both the first and second induction coils have connectors thereon for connecting the coils to at least one power supply for energizing the first and second induction coils. A support is provided for supporting the metal from below, and has an opening through it. The support includes a raised segmented rim around substantially its entire periphery. The support is maintained at a preselected temperature. In an alternate embodiment, structure is also provided for imparting rotational motion to the support.

7 Claims, 3 Drawing Sheets

MAGNETIC SUSPENSION MELTING APPARATUS

FIELD OF THE INVENTION

The present invention relates to magnetic suspension melting, sometimes referred to as MSM, in which metal is melted by electromagnetic induction without the need for a crucible. Instead, a magnetic field is used to contain the melt.

BACKGROUND OF THE INVENTION

In the manufacture of metal castings it is important to avoid contamination of the metal with non-metallic inclusions. These inclusions are usually oxide phases, and are usually formed by reaction between the metals being melted and the crucible in which they are melted. It has long been an aim of metal casters to avoid such contamination by using crucibles which have minimum reactivity with the melts. However, some alloys, in particular nickel-based superalloys, which may contain substantial amounts of aluminum, titanium, or hafnium, react vigorously with oxide crucibles and form inclusions during melting.

Heretofore there have been two main methods of avoiding contamination from a crucible in metal smelting. One method is "cold-crucible"melting, in which a water cooled copper crucible is used. The metal charge, which may be melted by induction, electric arc, plasma torch, or electron beam energy sources, freezes against the cooled copper crucible wall. Thereafter, the liquid metal is held within a "skull" of solid metal of its own composition, and does contact the crucible wall.

Another method is levitation melting. In levitation melting, a quantity of metal to be melted is electromagnetically suspended in space while it is heated. U.S. Pat. No. 2,686,864 to Wroughton et al. and U.S. Pat. No. 4,578,552 to Mortemer show methods of using induction coils to levitate a quantity of metal and heat it inductively.

Cold crucible melting and levitation melting necessarily consume a great deal of energy. In the case of cold-crucible melting, a substantial amount of energy is required merely to maintain the pool of molten metal within the skull, and much of the heating energy put into the metal must be removed deliberately just to maintain the solid outer portion. With levitation melting, energy is required to keep the metal suspended. In addition, as compared to the surface of a molten bath in a conventional crucible, levitation melting causes the quantity of metal to have a large surface area, which is a source of heat loss by radiation. Additional energy is required to maintain the metal temperature.

For alloys which are mildly reactive with crucibles, such as the nickel-base superalloys referred to above, a process called the "Birlec" process has been used. This process was developed by the Birmingham Electric Company in Great Britain. In the Birlec process, induction is used to melt just enough metal to pour one casting. Instead of pouring metal from the crucible conventionally, however, by tilting it and allowing the melt to flow over its lip, the crucible has an opening in its bottom covered with a "penny or "button" of charge metal. After the charge is melted, heat transfer from the molten charge to the penny melts the penny, allowing the molten metal to fall through the opening into a waiting casting mold below.

By using a small quantity of metal with the proper induction melting frequency and power in the Birlec process, the metal can be "haystacked," or partially levitated, and held away from the crucible sides for much of the melting process, thus minimizing, although not eliminating, contact with the crucible sidewall. Such a process is in use today for the production of single crystal investment castings for the gas turbine industry.

The use of "haystacking" to melt refractory and titanium alloys was tried by the U.S. Army at Watertown Arsenal in the 1950s, using carbon crucibles, but was not successful in eliminating carbon contamination from the crucible, and there was no satisfactory method of controlling the pouring temperature of the metal to the accuracy desired for aerospace work.

These problems have been solved to a large extent by placing the metal charge to be melted within an induction coil, which exerts on the metal an electromagnetic force which is greater near the bottom of the charge than near the top of the charge. The charge is free-standing on a support plate, which has an opening through it through which liquid metal may drain into a mold or other container placed below the support plate as the charge melts. The support is cooled to a preselected temperature. This technique, sometimes referred to as magnetic suspension melting, or MSM, is disclosed in U.S. Pat. Nos. 5,014,769 and 5,033,948, assigned to the same assignee as the present invention. Familiarity with the MSM process disclosed in those two patents to those skilled in the art is assumed, and that process will not be described in detail herein.

It has been found, however, that while the MSM technique works well for many metals, it is not so effective for certain high-melting temperature metals such as steel, titanium and superalloys. It is believed that, because of magnetohydrodynamic flows within the molten metal, the metal develops instabilities which cause the charge of molten metal to collapse prematurely, before the entire charge becomes molten. In such cases, the molten metal runs off the side of the charge, rather than through the opening in the support plate, as it is intended to.

The present invention solves the problem of instabilities in the molten metal and makes the MSM technique effective for the melting of steels and superalloys.

SUMMARY OF THE INVENTION

The present invention is directed to apparatus for inductively melting a quantity of metal without a container. The apparatus comprises a first induction coil having a plurality of turns defining a volume for receiving a quantity of metal, the first induction coil being adapted to exert a force on the metal, and a second induction coil having a plurality of turns at substantially right angles to the turns of the first induction coil, the second induction coil being disposed within said volume coaxial with the first induction coil. Both the first and second induction coils have means thereon for connecting the coils to at least one power supply means for energizing the first and second induction coils. Support means are provided for supporting the metal from below. The support means has an opening through it. The support means includes a raised segmented rim around substantially the entire periphery thereof. The support means is maintained at a preselected temperature.

In an alternate embodiment, means are also provided for imparting rotational motion to the support means.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
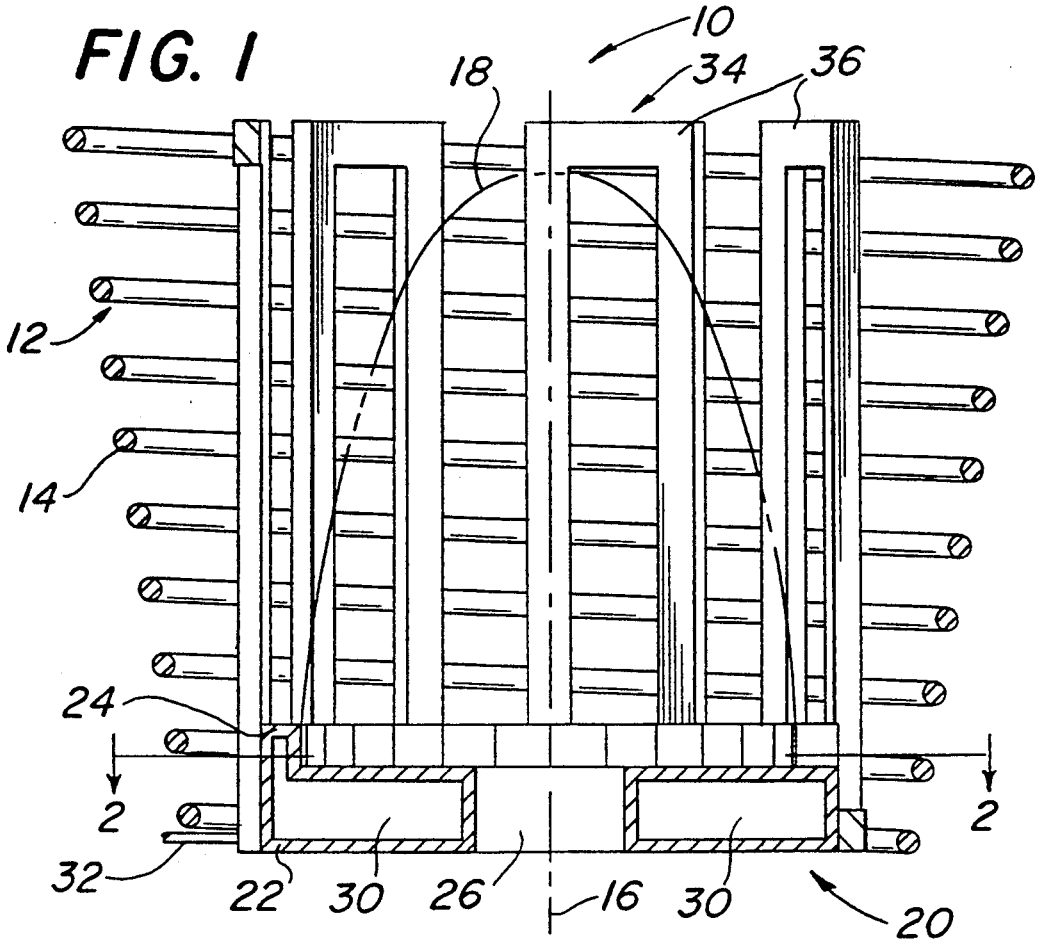
FIG. 1 is a side elevational view, in section, showing the major components of one form of apparatus according to the present invention.
Figure 2:
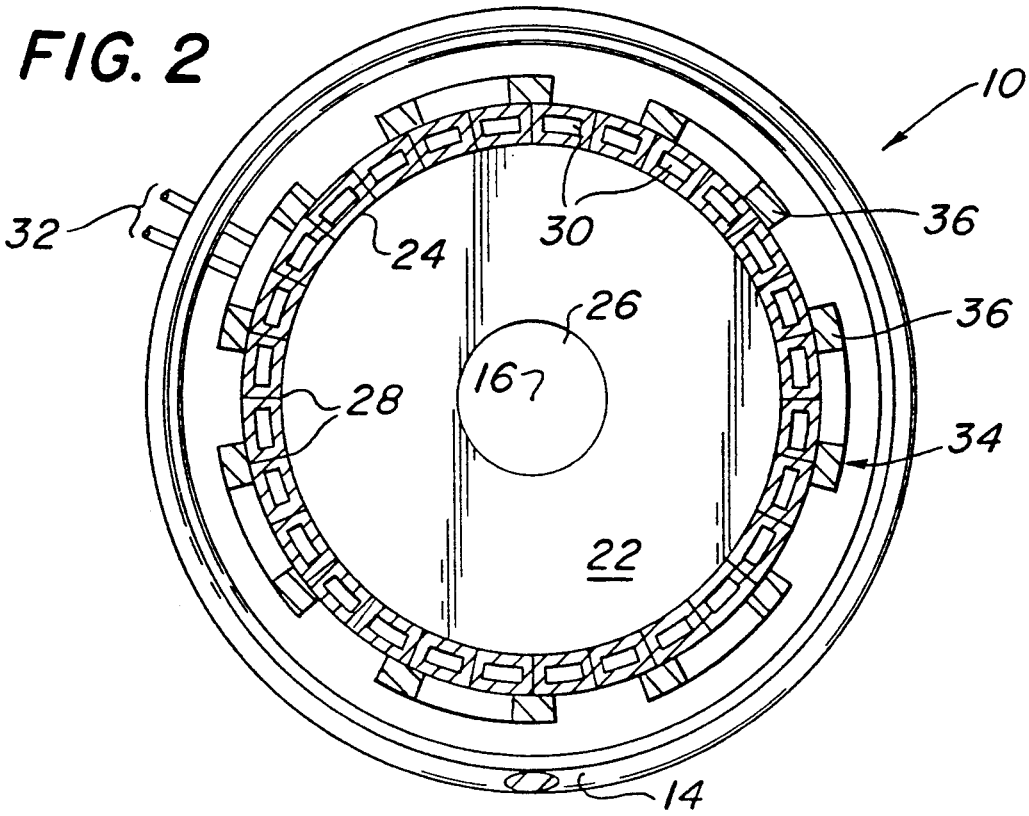
FIG. 2 is a sectional view of the apparatus of FIG. 1, taken along the lines 2—2 in FIG. 1.
Figure 3:
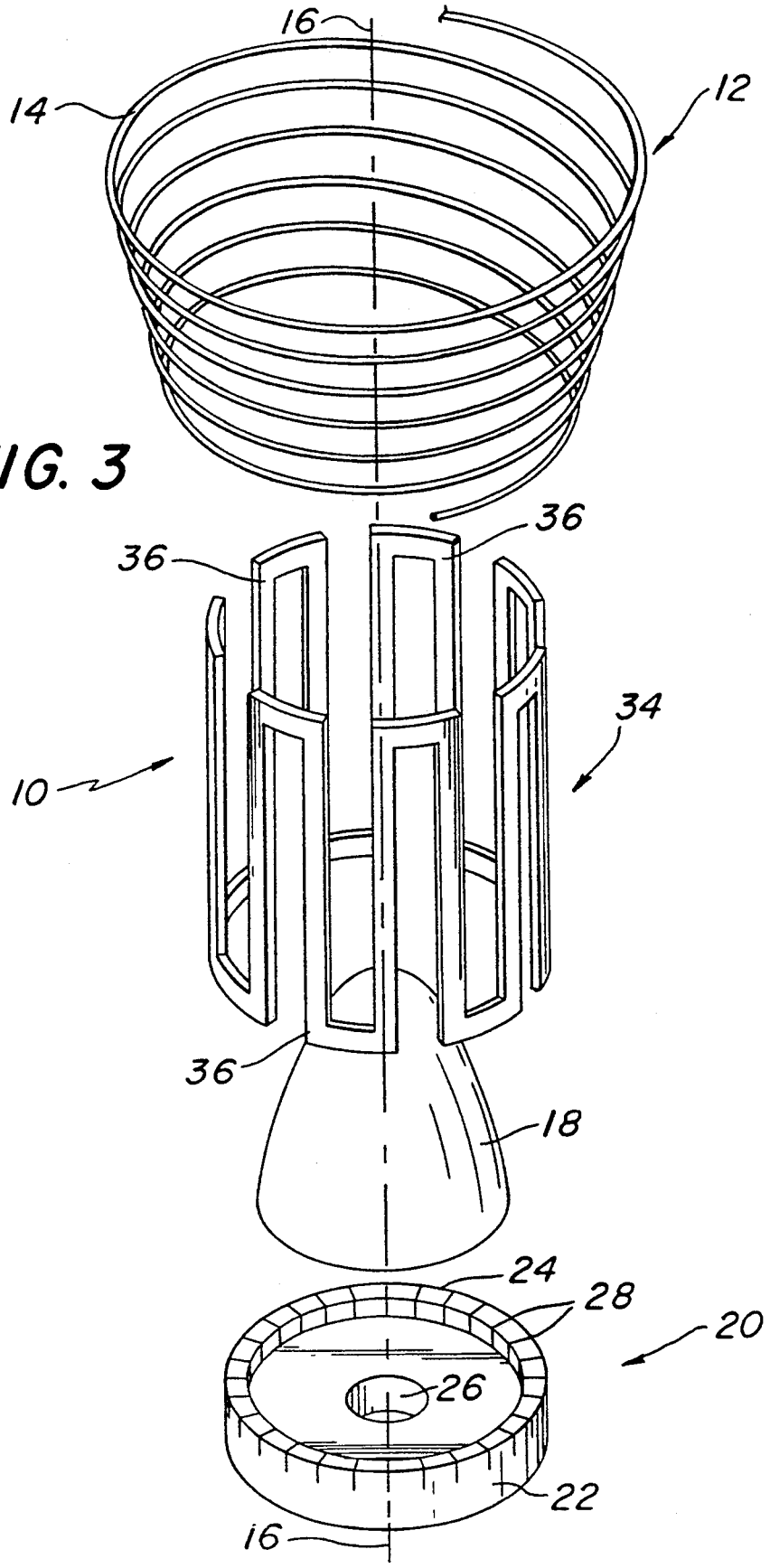
FIG. 3 is an exploded view of the apparatus of FIG. 1.

Referring now to the drawings, wherein like numerals indicate like elements, there is shown in the figures a magnetic suspension melting apparatus 10 according to the invention. (Reference may also be made to U.S. Pat. Nos. 15,014,769 and 5,033,948, the disclosures of which are incorporated herein by reference.) Apparatus 10 comprises a first induction coil 12, which has a plurality of helical turns 14 centered about a central axis 16. First induction coil 12 is, for purposes of this invention, constructed in known manner. First induction coil 12 includes connector means for connecting coil 12 to a high-frequency power supply (not shown) for energizing coil 12 in known manner with a high-frequency alternating current. The high-frequency alternating current in first induction coil 12 induces currents to flow in metal to be melted. The induced currents in the metal heat and eventually melt the metal, as is well-understood in the art.

The turns 14 of coil 12 define an interior volume in which is received a quantity, or charge, of metal 18, shown in phantom in FIG. 1, to be melted by the apparatus 10. Metal charge 18 is supported by a support means 20 in the form of an annular plate 22 which has a raised annular rim portion 24 around substantially the entire circumference of plate 22. Support means 20 has a central opening 26 therethrough, through which molten metal 18 runs by gravity into a mold or other container (not shown) after being melted by first induction coil 12.

Rim portion 24 of support means 20 is preferably not continuous but is segmented. That is, the rim is provided with a plurality of gaps or slots 28 at angularly-spaced intervals. These gaps or slots 28 allow the magnetic field generated by the first induction coil 12 to more easily couple to and penetrate the metal charge 18. A typical flat plate, without a raised rim, cannot be made slotted (since to do so would enable molten metal to run through the slots), and, accordingly, magnetically couples to the induction coil. Especially in cases where the metal charge 18 has high resistivity, a typical flat plate attenuates the magnetic field in the lower sections of the charge, where the magnetic supporting force needs to be the strongest. In contrast, the slotted rim portion 24 of support means 20 enables the maximum amount of magnetic force to be applied to the lower sections or charge 18 with minimum attenuation by the support means 20. This supports the molten metal and constrains it to drain through the central opening 26, as desired. The gaps or slots 28 serve to break up currents induced in support means by first induction coil 12, so that very little of the energy of the magnetic field from first induction coil 12 is lost in coupling to the support means 20.

Support means 20 is preferably, although not necessarily, provided with internal cavities 30 through which water or other suitable coolant can be circulated to chill support means 20. As in the conventional MSM process, it is desired that support means 20 be kept at a relatively low temperature compared to the metal charge 18 so that metal in contact with and closely adjacent support means 20 will remain solid. Suitable conduits 32 can be provided for providing a flow of coolant to and from support means 20 and a source of coolant (not shown).

A second induction coil 34 is located between turns 14 of the first induction coil 12 and the metal charge 18. That is, second induction coil 34 is located within the interior volume defined by first induction coil 12. Second induction coil 34 has a plurality of turns 36 which are arranged at substantially right angles to the turns 14 of first induction coil 12. Thus, where the turns 14 of first induction coil 12 are generally horizontally disposed, the turns 36 of second induction coil 34 are generally vertically disposed. This gives second induction coil 34 a substantially cylindrical shape. Second induction coil 34 is also provided with suitable connectors for connecting it to a power supply (not shown), which may but need not be the same power supply to which first induction coil 12 is connected. Second induction coil 34 encompasses, but is spaced slightly away from, support means 20, so that both support means 20 and metal charge 18 are within the interior volume defined by second induction coil 34.

Second induction coil 34 is preferably excited by a high-frequency power supply (not shown), which causes second induction coil 34 to induce vertically-orientated electrical currents into the surface of metal charge 18 as the metal is being melted by first induction coil 12. This helps to reduce surface instabilities in the molten metal which could tend to adversely affect melting and subsequent flow of molten metal from central opening 26 in support means 20. That is, the surface of the molten metal tends to become smoother, and runoff of molten metal off the side of support means is prevented.

Figures 4A, 4B:
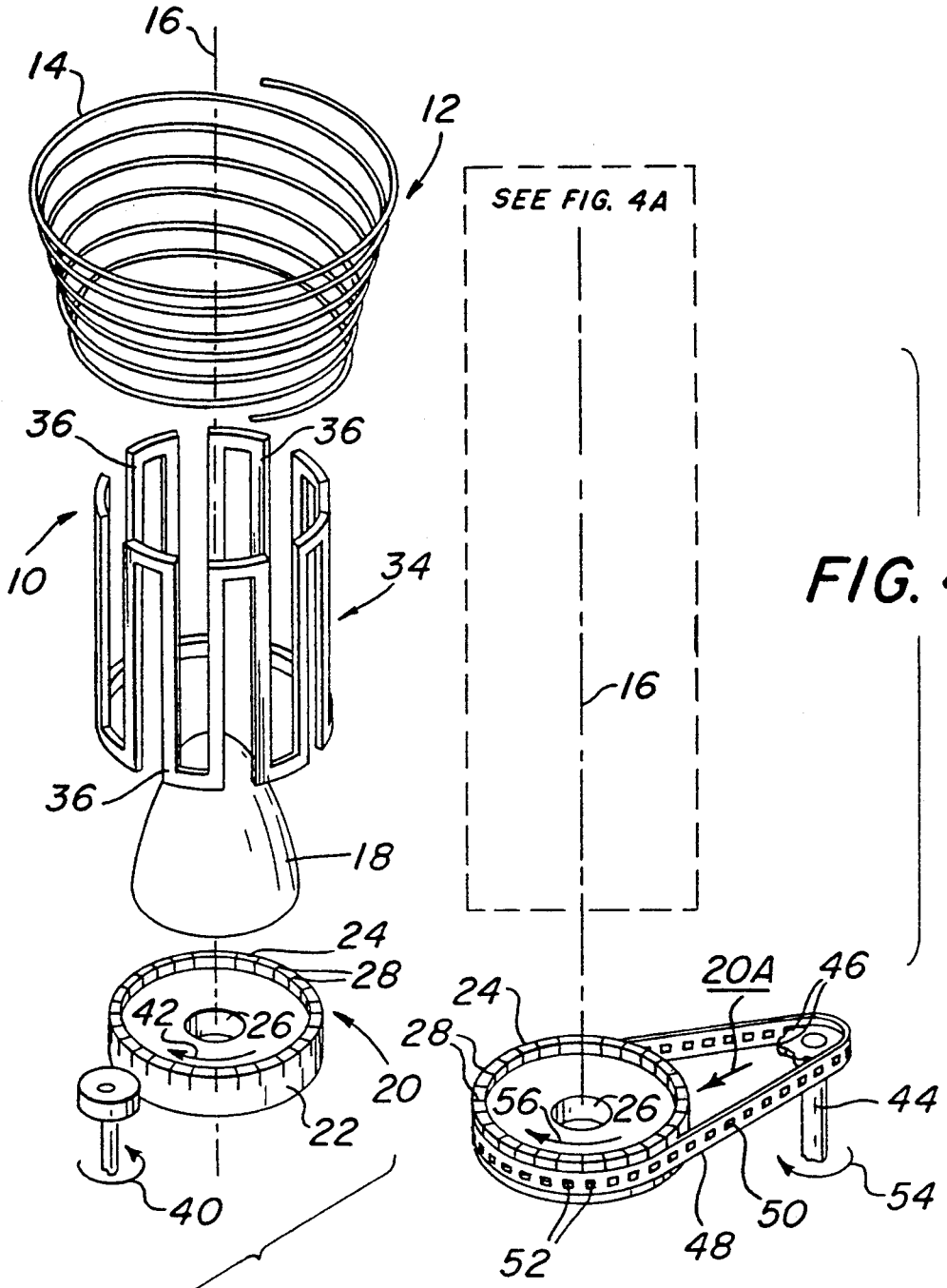
FIG. 4 is composed of FIGS. 4A and 4B illustrating alternate embodiments for imparting rotation to reduce surface instabilities in the molten metal.

To further reduce surface instabilities and stabilize the melting process, support means 20 may be rotated about axis 16. Any suitable structure may be used to rotate support means 20 relative to the remainder of apparatus 10, or the entire apparatus 10, including support means 20, may be rotated. Suitable structures for rotating support means 20 are shown in FIG. 4 which is composed of FIGS. 4A and 4B. FIG. 4A illustrates a first embodiment comprising a wheel 38 which is rotated in a particular direction 40; e.g., counterclockwise as shown, and which frictionally engages and imparts rotational movement to the support means 20 in a clockwise direction 42 about axis 16. FIG. 4B illustrates a second embodiment having many of the elements of FIG. 4A, but for the sake of clarity does not show elements 14, 18 and 36 shown in FIG. 4A. The embodiment of FIG. 4B comprises a sprocket wheel 44 having sprockets 46, a chain 48 having separations 50 serving as links, and a support means 20A which is the same as support means 20 except that it has sprockets 52 uniformly distributed about the outside circumference. The sprocket wheel 44 is rotated in a particular direction 54; e.g., clockwise as shown, and its sprockets 46 engage links 50 and cause the rotation of chain 48. The links 50 of the chain 48 are also engaged by sprockets 52 which in turn impart rotational movement of support means 20A in a clockwise direction 56 about axis 16. Regardless of the actual means employed to impart rotational movement to support means 20, the centrifugal force imparted to the molten metal 18 as support means 20 is rotated counteracts surface instabilities generated by the melting process and helps to smooth the surface of the molten metal.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for inductively melting a quantity of metal without a container, comprising a first induction coil having means thereon for connecting it to a power supply means for energizing the first induction coil, the first induction coil also having a plurality of turns defining a volume for receiving a quantity of metal, the first induction coil being adapted to exert a force on the metal, a second induction coil having means thereon for connecting it to a power supply means for energizing the second induction coil, the second induction coil also having a plurality of turns at substantially right angles to the turns of the first induction coil, the second induction coil being disposed within said volume coaxial with the first induction coil, a support means for supporting the metal from below and having an opening therethrough, the support means including a raised segmented rim around substantially the entire periphery thereof, and means for maintaining the support means at a preselected temperature.

2. Apparatus according to claim 1, further comprising means for imparting rotational motion to the support means.

3. Apparatus according to claim 1, wherein the first induction coil is substantially helical in configuration.

4. Apparatus according to claim 1, wherein the second induction coil is substantially cylindrical in configuration.

5. Apparatus as in claim 1, wherein the first induction coil, second induction coil, and support means are all disposed along a common axis.

6. Apparatus as in claim 2, wherein the first induction coil, the second induction coil, and support means are all disposed along a common axis, and wherein the support means is rotated about the common axis.

7. Apparatus for inductively melting a quantity of metal without a container, comprising a first induction coil having means thereon for connecting it to a power supply means for energizing the first induction coil, the first induction coil being substantially helical in configuration with a central axis therethrough and having a plurality of turns defining an interior volume for receiving a quantity of metal, the first induction coil being adapted to exert electromagnetic force on the metal, a second induction coil having means thereon for connecting it to a power supply means for energizing the second induction coil the second induction coil being substantially cylindrical in configuration with a central axis therethrough and having a plurality of turns at substantially right angles to the turns of the first induction coil, the second induction coil being disposed within said interior volume of said first induction coil and coaxial with the first induction coil, an annular support means for supporting the metal from below and having a centrally-located opening therethrough, the support means including a raised segmented rim around substantially the entire periphery thereof, said support means having an axis substantially the same as the axes of the first and second induction coils, means for maintaining the support means at a preselected temperature, and means for rotating the support means about its axis.

* * * * *